US005314658A

United States Patent [19]

Meendering et al.

[11] Patent Number: 5,314,658

[45] Date of Patent: May 24, 1994

[54] CONDITIONING METAL POWDER FOR INJECTION MOLDING

[75] Inventors: David N. Meendering, Willoughby Hills, Ohio; Deepak Malhotra, Golden; Linda K. Baltich, Arvada, both of Colo.

[73] Assignee: AMAX, Inc., New York, N.Y.

[21] Appl. No.: 869,724

[22] Filed: Apr. 3, 1992

[51] Int. Cl.[5] ..... B22F 1/00

[52] U.S. Cl. ..... 419/33; 419/23; 419/30; 419/36; 419/37; 419/38

[58] Field of Search ..... 419/23, 30, 33, 36, 419/37, 38

[56] References Cited

U.S. PATENT DOCUMENTS

| | | | |
|---|---|---|---|
| 4,369,078 | 1/1983 | Ascund | 148/126 |
| 4,784,335 | 11/1988 | Huether | 241/20 |
| 4,929,418 | 5/1990 | Branovich et al. | 419/19 |
| 5,007,957 | 4/1991 | Penxunas et al. | 75/252 |
| 5,063,021 | 11/1991 | Anand et al. | 419/12 |
| 5,091,020 | 2/1992 | Kim | 148/101 |
| 5,095,048 | 3/1992 | Takahashi et al. | 523/223 |
| 5,124,119 | 6/1992 | Grensing | 419/19 |
| 5,126,104 | 6/1992 | Anand et al. | 419/12 |
| 5,137,565 | 8/1992 | Taplin et al. | 75/238 |

*Primary Examiner*—Donald P. Walsh
*Assistant Examiner*—Daniel Jenkins
*Attorney, Agent, or Firm*—Hopgood, Calimafde, Kalil, Blaustein & Judlowe

[57] ABSTRACT

Tungsten and molybdenum powders are advantageously conditioned for metal injection molding by fluid energy milling the powder prior to batching. A preferred method of conditioning, jet milling, has been found to beneficially effect the particle characteristics to render the metal powder more suitable for injection molding.

23 Claims, No Drawings

CONDITIONING METAL POWDER FOR INJECTION MOLDING

BACKGROUND OF THE INVENTION

1. Field of the Invention

The present invention relates to a method for conditioning metal powder to provide an improved feedstock for injection molding.

2. The State of the Art

There are a variety methods of forming parts from commonly used engineering materials. The artisan's choice of a desired processing method is often constrained by the material of which the part is composed and the final geometry of the part. Thus, one may take a block of material and machine it to the desired shape within the design tolerances, but environmental considerations (such as the dust generated) and tool wear caused by machining often make such processing uneconomical.

Recent advances in pure and applied sciences have created a need for high tolerance parts in relatively complex shapes; that is, shapes other than the common block, rod, disk, billet, and such shapes common for raw or semi-finished materials. For engineering plastics, this need has been fulfilled for some applications by injection molding, which is a conventional plastics processing technology. Injecting a polymer solution or melt into a closed mold affords the production of a final piece having the geometry of the mold. Mold making arts, especially for plastics injection, have advanced to providing molds with very high dimensional tolerances. While polymer compositions may shrink or even expand upon curing, thus requiring the mold designer to compensate for the volume change, the advantages of injection molding come from the ability of the injected fluid composition to completely fill the mold and thereby assume a complex geometry. If the mold is designed accurately and is completely filled by the injected composition, then the as-molded part is expected to have a high dimensional tolerance and very little machining may be necessary to yield the final part.

The injection molding of plastics (i.e., polymeric compositions) is facilitated by the ability of such compositions to flow. As alluded to above, a polymer may be dissolved in a solvent, injection molded, and the solvent driven off by heating; the polymer may be melted and then injection molded; or a prepolymer or monomeric composition may be injection molded with a catalyst to promote curing in the mold. In any case, the advantages of injection molding of plastics are afforded by providing a pourable, pumpable, or otherwise flowable composition suitable for injection molding.

Recent developments in such arts as electronics and engine technology have created a need for complex parts comprised of inorganic materials such as metals and ceramics. Some metal parts of complex shapes may be fabricated by stamping them out of a sheet; however, this process is wasteful (not all of the sheet is used, and the rest may not be able to be recycled economically), may not provide sufficiently high tolerances, and can create stresses within the part stamped from the sheet.

More recent advances in the arts of injection molding have been applied to metals (often termed "metal injection molding," MIM, or "powder metal molding," PMM). In general, injection molding of metal powders involves first mixing or "batching" the powder with a carrier vehicle and/or a binder, and then injection molding the batched powder to produce a "green" article. This green article typically is first processed to remove any remaining organic constituents and then densified or "sintered" to produce a final metal article. There are other techniques for forming complex parts from metals. A metal may be cold- and/or hot-worked to arrive at the desired product.

One of the primary considerations for any injection molding process, whether of a plastic or metallic composition, is the viscosity of the injected composition. Whether the initial composition is a polymer solution or a dispersion of metal particles in a fluid (a "slurry"), energy is required to pump the injected composition into the mold. The ease with which the compostion flows into the mold will have numerous effects on the part itself, the molding apparatus, and the economics of the process. A more viscous slurry will require more energy to be injected into the mold, and thus more expensive apparatus is needed both to create the high injection pressures and to keep the mold closed (to prevent the slurry from leaking out under this high injection pressure). A more viscous slurry also requires a high injection pressure to assure that the mold is completely filled with the composition. Still further, a viscous slurry may fold over onto itself (similar to a thick syrup) during injection into the mold; these folds can trap gas bubbles, resulting in porosity and/or other defects in the final article. Slurries of inorganic particles such as metals are also quite abrasive, and higher injection pressures result in even more abrasion in the flow channel and in the mold; this leads to increased maintenance costs due to the more frequent replacement of very expensive items such as high tolerance molds.

When making a slurry, the art may describe the fluid with which the powder is mixed as a vehicle, a solvent, a binder, or any number of similar terms, often dependent upon the nature of the injection molding process. For any fluid system, the viscosity is effected by a myriad of variables. For example, the viscosity of a slurry composed of metal powder and a fluid vehicle will be effected by the characteristics of the solids (metal powder), the liquid (vehicle), and their interrelationship.

More particularly, the average particle size, the particle size distribution, and the shape of the metal particles will effect the viscosity. Very small particles will typically result in a more viscous slurry than with the same volume fraction of larger particles. Particles of an essentially uniform size typically will result in a lower viscosity slurry than particles having a high aspect ratio; "aspect ratio" is generally defined as the ratio of the particle length to its width or diameter, so a spherical particle has a low aspect ratio ($L \approx D$) and a whisker or fiber-like particle has a high aspect ratio ($L >> D$). The fluid itself, without having any particles dispersed in it, will also have some inherent viscosity. The viscosity of the fluid will increase as the volume fraction of the metal powder particles dispersed increases. Still further, the characteristics of the metal powder particles may promote or inhibit the formation of microscopic structures in the fluid, thereby leading to changes in the viscosity depending upon the shear rate, and possibly also a time-dependent shear-viscosity relationship.

The production of a flowable, pumpable, or injectable mixture of powder and vehicle advantageously allows production of parts by injection molding. However, the art of dispersing solids in a fluid or fluidizable vehicle depends primarily upon empirical experimentation to determine useable and optimal systems. The fluidity (including pourability, pumpability, and other rheological aspects) of the feedstock generally depends upon various characteristics of both the solid and liquid phases. One of the most conventional methods for altering the viscosity of a slurry, although still determined empirically, is by the use of one or more dispersants. This determination is empirical because of the myriad interactions in the liquid-solid system and thus some dispersants may lower viscosity while others may increase viscosity; also, a suitable dispersant for use at a design shear rate may not be suitable at a different shear rate.

A disclosure in the art of MIM by Bernard Williams ("Cost Effective Production of Fine Metal Powders by Fluidised Bed Jet Milling," *Metal Powder Report*, Shrewsbury, UK, Jan. 1989, pp. 38–40) only teaches that "fine" metal powders having an average particle size of less than 20 μm are suitable for injection molding. Williams also describes that to achieve this criterion, the optimum starting material for fluidized bed jet milling should have an average particle size of less than 2 mm, preferably 50–300 μm. Without disclosing the actual characteristics of the starting powders, Williams describes product powders of various compositions having average particle sizes ranging from 0.9 μm to 14 μm, with 97% of the product having sizes ranging from less than 2 μm to less than 36 μm. This article also lacks any quantitive assessment by which the actual suitability for injection molding the product powders could be judged.

Given these and other parameters that effect the rheology of a solids dispersion, and the empirical nature by which workable vechicle-solid systems are devised, it is not readily predictable which systems will result in useable, injectable feedstocks.

SUMMARY OF THE INVENTION

Accordingly, it is an object of this invention to provide an improved process for mechanically treating as-received metal powders to produce a more easily flowable feedstock for injection molding. More particularly, this invention provides feedstocks suitable for injection molding tungsten and/or molybdenum particles.

In one aspect, this invention provides a metal powder feedstock by a preprocessing treatment which comprises the steps of providing an as-received metal powder and conditioning this metal powder by fluid energy milling to render the powder more suitable as an injection molding feedstock. The as-received metal powder to be conditioned preferably has an average particle size of less than about 15 μm, more preferably less than about 10 μm.

In another aspect, this invention provides a process for injection molding a metal powder selected from the group consisting of tungsten, molybdenum, and mixtures thereof, which comprises the steps of conditioning an as-received metal powder by fluid energy milling, batching the powder with a vehicle, injection molding the batched powder into a green shape, removing the vehicle, and densifying the green shape.

In yet another aspect, the invention provides an improvement to a process for injection molding metal powder, which process includes the steps of batching powder with a vehicle to produce a feedstock and injection molding the feedstock, wherein the improvement comprises conditioning the metal powder by fluid energy milling prior to batching.

BRIEF DESCRIPTION OF THE FIGURES

FIGS. 1*a*–1*d* are SEM (i.e., scanning electron microscope) photomicrographs at 2000× magnification of as-received molybdenum powder at FIG. 1*a*, ball-milled in FIG. 1*b*, and jet-milled in FIGS. 1*c* and 1*d*.

DETAILED DESCRIPTION OF PREFERRED EMBODIMENTS

As noted in the Background section, the injection molding of metal powders (MIM; Metal Injection Molding) typically involves taking a powder received from a commercial supplier (an "as-received" powder) and processing the powder into a feedstock suitable for MIM.

The processing may include any of a number of operations to provide the desired average particle size and/or particle size distribution. For example, the as-received powder may be wet- or dry-milled to reduce the average particle size, which milling is done typically in the presence of milling media; the milling media physically impact the particles to break up both agglomerated and individual particles. Wet-milling, that is, milling in the presence of a liquid medium, is generally preferred because it alleviates dust from dry milling fine particles. Milling media generally consist of large, regularly shaped particles of a hard material which does not wear substantially and does not significantly contaminate the powder. These parameters typically may be fulfilled, for example, by zirconia or tungsten carbide media in the shape of balls, rods, or disks of a size ranging from about ½ cm. to about 2 cm. The use of spherically-shaped milling media has resulted in this type of milling being referred to generally as ball milling or pebble milling. The energy imparted by the mill and the duration of milling effect the resulting average particle size and distribution. Milling may also be accomplished with an attritor, essentially a milling device with rotating paddles.

For non-brittle, essentially malleable powders like metals, milling can be viewed as a combination of welding and attrition. Typically, inorganic powders are milled to reduce their size by attrition or fracture as the powder particles collide with each other and the milling media. However, for metal powders the collision between powder particles does not necessarily reduce their size; rather, the colliding particles may become welded together. From a kinetic viewpoint, an equilibrium condition defined by a certain average particle size and a certain particle size distribution depends upon the competing reactions of attrition/fracture and welding. Also, while inorganic powders are often milled in a liquid medium, the presence of a liquid can interfere with this welding phenomenon for metal powders.

Another operation which might be performed to provide metal particles having desired characteristics includes centrifugal or other types of classification. These operations produce a desired particle size range and/or distribution from a broader size distribution. Such systems can be used to centrifugally fractionate particles larger than and/or smaller than a specific size. With knowledge of the starting particle size distribution and the range of particle size fractions which can be removed, it is possible to create a powder having a desired average particle size and/or particle size distribution.

Unexpectedly, we have discovered that conditioning the metal powder, especially comprised of molybdenum or tungsten, by fluid energy milling can provide an MIM feedstock improved over one produced by conventional milling (e.g., rod or pebble milling). Jet milling is the preferred method for conditioning by fluid energy milling. For example, the jet milled powder has a reduced particle size, and yet we have discovered the unexpected advantage that the jet milled powder nevertheless provides a slurry with a lowered resistance to flow. It is nevertheless important to appreciate that this sort of conditioning may not result in any appreciable size reduction of the powder. Thus, this invention is not milling to alter the average particle size, but rather is the use of fluid energy milling to provide a metal powder product improved for injection molding, and the product so produced.

In the present invention, the preferred conditioning method is fluid energy milling or jet milling. Fluid energy mills generally grind materials very fine and minimize contamination of the powder product. More particularly, a jet mill is a device with at least two gaseous fluid streams into which solid particles are swept or fluidized. The streams are directed at each other such that particles from one stream collide with particles from another. These collisions effectively reduce the particle size, like milling with media, by breaking up agglomerated particles or fracturing particles. When air is used as the gaseous sweeping stream, the process can be termed "air-swept" milling.

In air-swept milling operations, feed powder is injected into a reduction chamber and entrained in a flow of air or other fluid. Pressurized fluid may also be discharged into the chamber through peripheral nozzles. The jet action in the reduction chamber breaks up the individual particles by interparticle collisions. As the particles circulate in the chamber, centrifugal force shifts the larger, heavier particles towards the outside for regrinding. Finer particles are discharged preferentially by this centrifugal action, similar to a cyclone as used for particle separation. It may be preferrable to continuously remove particles smaller than a desired size from the mill. Accordingly, air-swept milling and particle classification may be combined in a single operation.

Fluid pressure and feed rate may be adjusted to obtain the desired characteristics for injection molding the product powder. For a given metal powder, the relationship between throughput and operating pressure must be established experimentally to obtain the optimum particle-particle interaction. For example, at throughputs lower than optimum, an insufficient number of particles may be present for adequate particle-particle interaction. At higher throughputs, a cushioning effect caused by particle crowding likewise may prevent sufficent interaction. We have found that maximum particle fineness may be obtained using the maximum pressure attainable with the unit. In general, though, a low feed rate is used initially, and the rate is increased until an optimum loading condition is found to produce a desired product. The pressure and feed rate can be varied as necessary to achieve the desired product.

The collection of fines from the mill is one factor in providing a powder having the desired characteristics. High efficiency in a production environment may be achieved through the use of cycloning and/or classification schemes. Although more of a problem when using bench and/or pilot scale apparatus, the yield can be improved by taking steps to reduce the loss of airborne fines and to remove them as product.

Another factor in providing a moldable powder is the size distribution of the powder. In general, jet milling produces a product having a slightly more narrow particle size distribution than the starting material given the same feed rates. Thus, if the feed has a narrow distribution of particle sizes, the product can be expected to have a very narrow distribution. If the feed has a wide distribution, the product most probably cannot economically be produced with the same narrow distribution.

As-received molybdenum metal powder, produced by the hydrogen reduction of molybdenum trioxide and commercially available from Climax Specialty Metals (Cleveland, Ohio) under the trademark Pure Molybdenum, and characterized by having an average particle size of 9.5 μm after passing through a −325 Mesh (≦45 μm) screen, a specific surface area of 0.20 $m^2/g$, and a tap density of 1.66 g/cc, was divided into different lots and subjected to both ball milling and jet milling. The "tap density" was determined by weighing a quantity of powder, transferring the weighed quantity to a graduated cylinder, and tapping the loaded graduated cylinder on a hard surface to shake down the powder. While commercially available apparatus for accomplishing this test generally may require 300 taps, we have found it sufficient for testing if tapping is continued until there is no visually perceptible volume change in the cylinder; this typically requires only twenty or twenty-five taps. The tap density thus is determined as a weight per unit volume (i.e., the weight amount and the final volume occupied in the graduated cylinder). The average particle size was determined using a Micromeritics Sedigraph, and the surface area was determined using a Quantasorb apparatus.

The jet milling was performed on a Model 8-inch MICRO-JET mill (available from Fluid Energy Processing & Equipment Company, Hatfield, Pa.) at 5 lb/hr throughput for 6 hrs duration at an operating pressure of 100 psi. The powder was conditioned as-received from Climax Specialty Metals. After conditioning by jet milling, the resulting powder had an average particle size of 4.4 μm, a specific surface area of 0.31 $m^2/g$, and a tap density of 2.96 g/cc. The powder was also jet milled using a 4-inch MICRO-JET mill.

The ball milling was performed in a 8"×10" laboratory batch ball mill for periods of two and four hours with cast iron balls as the milling media (ball size ranged from ½" to 1"), and preferably including a tungsten carbide liner for the mill. The resulting powder exhibited a mean particle size of 7.6 μm after two hours and 4.8 μm after four hours. The specific surface area was not effected appreciably after two hours of milling, and increased only to 0.24 $m^2/g$ from 0.20 $m^2/g$ after four hours of milling. The tap density increased to 2.15 g/cc from 1.66 g/cc after two hours, and to 2.66 g/cc after four hours of ball milling. These results are summarized in Table 1 below.

TABLE 1

| Milling Procedure | $\bar{d}$ μm | Actual Surface Area $m^2/g$ | Theoretical Surface Area $m^2/g$ | Actual Tap as % of Theoretical | Density g/cc |
|---|---|---|---|---|---|
| As-received | 9.5 | 0.20 | 0.062 | 323 | 1.66 |
| Ball Milled (2 hr.) | 7.6 | 0.20 | 0.077 | 260 | 2.15 |
| Ball Milled (4 hr.) | 4.8 | 0.24 | 0.122 | 197 | 2.66 |

TABLE 1-continued

| Milling Procedure | $\bar{d}$ μm | Actual Surface Area $m^2/g$ | Theoretical Surface Area $m^2/g$ | Actual Tap as % of Theoretical | Density g/cc |
|---|---|---|---|---|---|
| Jet Milled (8-inch) | 4.4 | 0.31 | 0.133 | 233 | 2.96 |
| Jet Milled (4-inch) | 5.2 | 0.13 | 0.113 | 115 | 2.78 |

From this data, it can be seen that the surface area has decreased as a percentage of theoretical but has increased in absolute terms. For example, a smooth sphere having a diameter of 9.5 μm would be expected to have a surface area of $2.835\times10^{-10}$ $m^2$, a mass (using $10.22\times10^6$ $g/m^3$ as the density for molybdenum) of $4.59\times10^{-9}$ g,, and thus the theoretical specific surface area (i.e., for a non-porous perfect sphere) would be 0.062 $m^2/g$. The actual specific surface area of 0.20 $m^2/g$ for the as-received powder is thus about 323% of the theoretical specific surface area. Using an analogous set of calculations for the jet milled powder, the theoretical specific surface area is 0.1334 $m^2/g$; accordingly, the specific surface area of 0.31 $m^2/g$ for the resulting powder is about 230% of the theoretical value.

Prior to evaluating the moldability of the milled powders, each was screened to −400 mesh (38 μm) to remove any agglomerates formed during milling and to remove larger impurities.

The as-received and each of the milled powders were mixed using a standardized binder comprised (on a weight basis) of 35% polypropylene, 40% paraffin wax, 19% peanut oil, and 6% castor oil. The mixing torques for various solids loadings (v/o represents volume percent) were conducted at 182° C. (360° F.). Using a torque rheometer (Hacke Rheocord Torque Rheometer, Model EU5V, with a 60 cc Rheomix Type 600 mixing chamber), the compositions were mixed at 32 rpm for 30 minutes, 128 rpm for 10 minutes, 250 rpm for 5 minutes, and 32 rpm for 30 minutes. The average torque during the last 30 minute period is shown in Table 2. As used herein and in the appended claims, the preceding conditions under which the mixing torque is measured and wherein the solids loading is 58 vol.% shall be referred to as "standardized torque measurement conditions" and the measurement taken under such conditions as the "standardized torque measurement." This invention provides a conditioned powder that exhibits a standardized torque measurment of not more than about 2.5 N-m, more preferably not more than about 2.2 N-m, and most preferably not more than 2.0 N-m.

TABLE 2

| | Mixing Torque Measurements (N-m) | | | |
|---|---|---|---|---|
| Loading | As-Received | Ball Milled (4 hr) | Jet Milled (8") | Jet Milled (4") |
| 56 v/o | 5.2 | 2.5 | 1.4 | 1.2 |
| 58 v/o | | 3.3 | 1.6 | 2.0 |
| 60 v/o | | | | 2.8 |
| 62 v/o | | | | 4.3 |

The as-received powder, exhibiting an average particle size of less than 10 μm, showed high torque values during mixing and the resulting mixture appeared visually to be very dry. The as-received mixture was not moldable using the apparatus as described below.

The powder ball milled for two hours was difficult to mold. The powder ball milled for four hours was moldable.

The jet milled powder showed low torque values during mixing. The resulting mixture appeared visually "wet" and was relatively easy to injection mold.

A mixture of 58 vol.% ball milled powder (four hour milling time) and 42 vol.% of the standardized binder described above was injection molded using a temperature profile of approximately 138/171/149/104° C. (280/340/300/220 ° F.). At the same solids loading level using another binder composed of 20% polypropylene, 69% paraffin wax, 10% carnauba wax, and 1% stearic acid, a temperature profile of 149/171/160/141 ° C. (300/340/320/300° F.) was found to be best. Unexpectedly, and advantageously, it was found that a temperature profile of approximately 11° C. (20° F.) lower could be used with jet milled powder. This is advantageous because of the thermally induced dimensional change of the binder: as the binder cools in the mold it shrinks. Thus, a lower injection temperature provides for a smaller temperature differential upon cooling, and thus a smaller dimensional change. In turn, the smaller dimensional change allows for higher dimensional tolerances on as-molded parts. Further, reduced shrinkage would be expected to result in reduced porosity in both as-molded and densified pieces.

The molded article is debound by any number of conventional means, as mentioned previously. Generally, debinding of a thermoplastic binder is by heat, although solvent extraction may be used. The as-molded article is heated to decompose or melt the thermoplastic. Depending upon the specific binder and the debinding environment (temperature, pressure, and atmosphere), the binder may decompose into oxidative reaction products, or it may depolymerize into its monomeric constituents. (Certain polymers depolymerize when the temperature is increased above what is termed the "ceiling" temperature.)

The results of more comprehensive testing are shown in Table 3 below. As seen in Table 3, even "fine" powders having an as-received average particle size of less than about 10 μm are beneficially conditioned by the present invention. For example, under standardized torque measurement conditions (i.e., 58 vol.% solids in the standardized binder), Lot C exhibits an as-received torque of 5.9 N-m for a powder having an average particle size of 6.8 μm. This torque value is not significantly improved upon by ball milling (Lot C-3β), which reduced the average particle size 22% to about 5.3 μm, with the resulting powder exhibiting a standardized torque measurement of 5.3 N-m, a 10% reduction. In contrast, conditioning by fluid energy milling (Lots C-1 and C-2) reduced the average particle size to 4.8 μm and 4.4 μm (29% and 35% reductions) but also reduced the standardized torque measurements to 2.0 N-m and 1.7 N-m (66% and 71% reductions). Therefore, contrary to what might have been expected, a powder having an as-received particle size of less than 10 μm can be conditioned by fluid energy milling such that the resulting powder has a significantly lower standardized torque measurment (even though the particle size of the conditioned powder also may be less).

After debinding, the green article is then densified. When metal powders are used, densification is typically by sintering. Densification may be accomplished by hot pressing or hot isostatic pressing, although pressureless sintering is preferred.

TABLE 3

| Sample[1] | As-received d̄ μm | As-received Densities (g/cc) Bulk | As-received Densities (g/cc) Tap | As-milled d̄ μm | As-milled Densities (g/cc) Bulk | As-milled Densities (g/cc) Tap | Mixing Torque Measured (N-m) At Various Vol. % Metal Loadings 56 | 58 | 60 | 62 |
|---|---|---|---|---|---|---|---|---|---|---|
| Lot A | 10.6 | 1.6 | 3.1 | | | | | | | |
| A-1 | | | | 7.2 | | | 1.3 | 2.0 | 2.8 | 4.3 |
| A-2 | | | | 5.4 | 3.1 | 5.4 | | | | |
| A-3 | | | | 5.2 | 2.5 | 5.3 | | 2.2 | 3.2 | |
| Lot B | 6.8 | 1.5 | 3.2 | | | | 5.9 | 6.3 | 6.4 | |
| B-1 | | | | 4.5 | 2.1 | 4.6 | 0.7 | 2.0 | 3.4 | 5.3 |
| B-2[2] | | | | 4.2 | 2.3 | 5.2 | | 5.2 | 5.8 | |
| B-3β | | | | 4.4 | 2.8 | 4.8 | 1.9 | 4.4 | 5.8 | 5.5 |
| Lot C | 6.8 | 1.5 | 3.6 | | | | 6.1 | 5.9 | | |
| C-1 | | | | 4.8 | 2.4 | 5.3 | 2.0 | 2.0 | 2.2 | 3.1 |
| C-2 | | | | 4.4 | 2.4 | 5.3 | 0.7 | 1.7 | 1.5 | 4.9 |
| C-3β | | | | 5.3 | 2.9 | 5.1 | 1.8 | 5.3 | 3.7 | 6.2 |
| C-4β | | | | 5.6 | 2.7 | 4.8 | 1.4 | 2.3 | 4.9 | 6.1 |
| Lot D | 6.4 | 1.6 | 3.5 | | | | 7.3 | 7.4 | 7.4 | |
| D-1 | | | | 5.0 | 2.4 | 5.2 | 0.8 | 2.1 | 2.1 | 4.4 |
| D-2β | | | | 5.8 | 2.9 | 4.7 | 2.3 | 5.2 | 5.2 | 5.0 |

[1]The designation "β" indicates that the powder was conditioned by ball milling for 4 hrs., except C-3β, which was ball milled for 24 hrs.; all other lots were jet milled.
[2]Jet milled at a high feed rate.

In another aspect it has been determined that the conditioned powders provide products having reduced shrinkage upon sintering. Thus, small electronic packages useful as rectifier bases were produced by metal injection molding a jet mill-conditioned molybdenum powder. The package geometry was in the shape of a cube having an open top (i.e., 5-sided cube) have a base measuring 13 mm×13 mm and four walls each 6 mm high; the thickness of the walls and the base was about 1.5 mm.

In one example, these packages were prepared by first blending 1306.4 g of molybdenum powder which had been ball milled for 4 hrs and screened to 100% −400 Mesh. This powder then was batched with 84.0 g of the standardized binder, heated to 182° C., blended for 75 minutes, cooled to slightly below room temperature, and the cooled mixture granulated. This yielded a composition containing about 58 vol.% metal powder. The granules were introduced to a plastic injection molding machine where they Were heated to 165° C. (329° F.); the injection die was pre-heated to 32° C. (90° F.). The mixture was then injected at 10,000 psi into a mold, left for a 30 second dwell, and the molded part was then ejected from the machine. Debound of the wax and oil components of the standardized binder was accomplished by immersion in methylene chloride (ambient room temperature) for 16 hours. Debinding of the polypropylene component was accomplished by heating the partially debinded parts under a hydrogen atmosphere over a rapid heating cycle reaching about 760° C. (1400° F.) in approximately 6.5 hrs. The parts were then pre-sintered by heating to 1000° C. (1832° F.) and holding for 2 hrs. Full densification was achieved by sintering at 1800° C. for 16 hrs in a hydrogen atmosphere having a dew point of about −57° C. (−70° F.). The average linear shrinkage for these parts is shown in Table 4.

As another example, molybdenum jet vanes were made using a molybdenum powder which had been conditioned by jet milling at a feedrate of 4.4 lbs/min at 60 psi. The resulting conditioned powder was batched with 76.0 g of the standardized binder, including the heating, blending, and granulating as described before, to provide a composition having about 62 vol.% metal powder. The mixture was molded as described previously, except that heating in the injection apparatus was to 171° C. (340° F.) and the die was pre-heated to 49° C. (120° F.). The parts were debound, pre-sintered, and sintered as described previously. The shrinkage and density are shown in the table.

The resulting average shrinkages and densities of a number of these parts using various solids loadings are shown below in Table 4:

TABLE 4

| | Metal Powder Loading (vol. %) 56% | 58% | 60% |
|---|---|---|---|
| % Average Linear Shrinkage | 15.4 | 14.7 | 13.6 |
| % Reducation in Shrinkage | — | 4.5 | 11.7 |
| % Theoretical Density | 96.5 | 96.8 | 96.9 |

FIGS. 1*a*–1*d* are SEM photomicrographs of molybdenum powder bore and after conditioning. FIG. 1*a* shows as-received powder, appearing to have a wide range of particle sizes and shapes. FIG. 1*b* shows the same powder after ball milling for 4 hrs; the powder does not appear appreciably different except that some of the larger particles may be slightly more regular in shape. FIGS. 1*c* and 1*d* show powders conditioned by jet milling; all of the particles appear slighly more regular and there appears to be a more narrow distribution of particle sizes, although it is difficult to infer any difference in average particle size.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A process for providing a metal powder feedstock, comprising:

A. providing an as-received metal powder having a non-spherical particle shape; and B. conditioning the as-received metal powder using a fluid energy mill effective to provide a metal powder feedstock suitable for injection molding.

2. The process as defined by claim 1, wherein the metal is tungsten, molybdenum, or mixtures thereof.

3. The process as defined by claim 2, wherein the conditioned powder has a distribution of particle sizes of 100% less than about 20 μm.

4. The process as defined by claim 2, wherein the conditioned powder has a mean particle size ranging between about 0.1 μm and about 10 μm.

5. The process as defined by claim 2, wherein the conditioning step includes jet milling.

6. The process as defined by claim 1, wherein the conditioned metal powder feedstock is characterized by a mixing torque of not more than about 2.5 N-m under standardized torque measurement conditions.

7. In a process for injection molding metal powder which includes the steps of batching the powder with a binder to produce a feedstock and injection molding the feedstock, an improvement which comprises conditioning a metal powder consisting essentially of tungsten and/or molybdenum by fluid energy milling prior to batching.

8. A process for injection molding a metal powder consisting essentially of molybdenum and/or tungsten, comprising:

A. conditioning an as-received metal powder having an average particle size of less than about 15 μm by subjecting said as-received metal powder to fluid energy milling;

B. batching the conditioned powder with a fluid selected from the group consisting of vehicles, binders, and solvents;

C. injection molding the batched powder into a desired green shape;

D. debinding the molded green shape to produce a green article; and

E. densifying the green article.

9. The process as defined by claim 7, wherein the milling is jet milling.

10. The process as defined by claim 7, further comprising the step of screening the milled powder prior to batching.

11. In a process for injection molding a metal powder slurry including the steps of providing a metal powder, batching the powder with a vehicle, molding the batched powder to form a green article, and sintering the green article, the improvement which comprises the steps of providing a powder consisting essentially of tungsten or molybdenum and having an average particle size of less than about 10 μm, and conditioning the powder in a fluid energy mill prior to batching so that the conditioned powder exhibits a standardized torque measurement of not more than about 2.5 N-m.

12. In a process for preparing a powder metal for injection molding by providing the powder and batching the powder with a fluid selected from the group consisting of vehicles, binders, and solvents, the improvement which comprises providing a powder consisting essentially of tungsten or molybdenum and milling the powder in a fluid energy mill prior to batching.

13. A process for providing a metal powder feedstock, comprising:

A. providing an as-received metal powder having a non-spherical particle shape; and B. conditioning the as-received metal powder in a fluid enery mill effective to reduce the average particle size and provide a metal powder feedstock suitable for injection molding.

14. The process as defined by claim 13, wherein the metal is tungsten, molybdenum, or mixtures thereof.

15. The process as defined by claim 14, wherein the conditioned powder has a distribution of particle sizes of 100% less than 20 μm.

16. The process as defined by claim 14, wherein the conditioned powder has a mean partricle size ranging between about 0.1 μm and about 10 μm.

17. The process as defined by claim 14, wherein the conditioning step includes jet milling.

18. The process as defined by claim 13, wherein the conditioned metal powder feedstock is characterized by a mixing torque of not more than about 2.5 N-m under standardized torque measurement conditions.

19. A process for injection molding a metal powder consisting essentially of molybdenum and/or tungsten, comprising:

A. conditioning an as-received metal powder having an average particle size of less than about 10 μm by fluid energy milling effective to decrease the average particle size;

B. batching the conditioned powder with a binder;

C. injection molding the batched powder into a desired green shape;

D. debinding the molded green shape to produce a green article; and

E. densifying the green article.

20. The process as defined by claim 19, wherein the fluid energy milling is jet milling.

21. The process as defined by claim 8, wherein the average particle size of the as-received powder is less than about 10 μm.

22. The process as defined by claim 8, wherein the fluid energy milling is jet milling.

23. The process as defined by claim 8, further comprising the step of screening the fluid energy milled powder prior to the step of batching.

* * * * *

UNITED STATES PATENT AND TRADEMARK OFFICE

CERTIFICATE OF CORRECTION

PATENT NO. : 5,314,658

DATED : May 24, 1994

INVENTOR(S) : David N. Meendering, et al.

It is certified that error appears in the above-identified patent and that said Letters Patent is hereby corrected as shown below:

Please delete the following paragraph appearing at column 10, lines 38-49:

"Figures 1a-1d are SEM photomicrographs of molybdenum powder bore and after conditioning. Fig. 1a shows as-received power, appearing to have a wide range of particle sizes and shapes. Fig. 1b shows the same powder after ball milling for 4 hrs; the powder does not appear appreciably different except that some of the larger particles may be slightly more regular in shape. Figs. 1c and 1d show powders conditioned by jet milling; all of the particles appear slightly more regular and there appears to be a more narrow distribution of particle sizes, although it is difficult to infer any difference in average particle size."

Signed and Sealed this

Thirtieth Day of August, 1994

*Attest:*

*Attesting Officer*

Bruce Lehman

BRUCE LEHMAN

*Commissioner of Patents and Trademarks*